United States Patent [19]

Asano et al.

[11] 4,089,313

[45] May 16, 1978

[54] CLOSED-LOOP AIR-FUEL MIXTURE CONTROL APPARATUS FOR INTERNAL COMBUSTION ENGINES WITH MEANS FOR MINIMIZING VOLTAGE SWING DURING TRANSIENT ENGINE OPERATING CONDITIONS

[75] Inventors: Masaharu Asano, Yokohama; Nobuzi Manaka, Yokosuka, both of Japan

[73] Assignee: Nissan Motor Company, Limited, Japan

[21] Appl. No.: 711,211

[22] Filed: Aug. 3, 1976

[30] Foreign Application Priority Data

Aug. 5, 1975 Japan ..... 50-94746

[51] Int. Cl.[2] ..... F02M 7/00

[52] U.S. Cl. ..... 123/119 EC; 123/32 EE; 123/32 EH; 123/32 EL

[58] Field of Search ..... 123/32 EE, 32 EH, 32 EL, 123/119 EC; 60/276, 285

[56] References Cited

U.S. PATENT DOCUMENTS

| | | | |
|---|---|---|---|
| 3,745,768 | 7/1973 | Zechnall et al. | 60/285 |
| 3,796,200 | 3/1974 | Knapp | 60/276 |
| 3,827,237 | 8/1974 | Linder et al. | 123/32 EE |
| 3,831,564 | 8/1974 | Schmidt et al. | 60/285 |
| 3,916,170 | 10/1975 | Norimatsu et al. | 123/32 EE |
| 3,938,479 | 2/1976 | Oberstadt | 123/32 EE |
| 3,949,551 | 4/1976 | Eichler et al. | 123/32 EE |
| 3,986,352 | 10/1976 | Casey | 60/276 |
| 3,990,411 | 11/1976 | Oberstadt et al. | 60/276 |
| 4,022,171 | 5/1977 | Laprade et al. | 123/119 EC |

*Primary Examiner*—Charles J. Myhre
*Assistant Examiner*—Andrew M. Dolinar
*Attorney, Agent, or Firm*—Robert E. Burns; Emmanuel J. Lobato; Bruce L. Adams

[57] ABSTRACT

Apparatus for controlling air-fuel mixture applied to internal combustion engines comprises an exhaust composition sensor providing an electrical signal representative of the concentration of a composition of the exhaust gases, an integral controller receptive of the electrical signal to generate a correction signal for the air-fuel mixing and proportioning device to control the air-fuel ratio at a desired value. An engine condition sensor is provided to detect transient engine operating conditions to generate a control signal which is used to maintain the output voltage of the integral controller at a predetermined constant value so that the voltage swing during vehicle acceleration or deceleration is held within a minimum range.

7 Claims, 8 Drawing Figures

CLOSED-LOOP AIR-FUEL MIXTURE CONTROL APPARATUS FOR INTERNAL COMBUSTION ENGINES WITH MEANS FOR MINIMIZING VOLTAGE SWING DURING TRANSIENT ENGINE OPERATING CONDITIONS

BACKGROUND OF THE INVENTION

The present invention relates to apparatus to control the air-fuel mixture supplied internal combustion engines through a closed loop in accordance with a detected exhaust composition, and in particular to such apparatus provided with means for minimizing control oscillation resulting from external disturbances caused by acceleration or deceleration of the engine.

It is known that the ratio of air-to-fuel of mixture supplied to internal combustion engines can be controlled at a reference point to reduce the noxious exhaust components using a sensed exhaust composition as a control signal to proportion the mass ratio of the mixture. Such a control system constitutes a closed loop including a sensor for detecting the exhaust composition and an integral controller receptive of the control signal to generate a correction signal for the air-fuel mixing and proportioning device such as carburetor or fuel injection system. Because of the inherent transport delay time which is defined as the time required for the air-fuel mixture to reach the cylinders of the engine, be combusted and exhausted and then travel through the exhaust system to the sensor, the integral controller keeps influencing the mixing and proportioning device after the reference point has been passed. As a result the system tends to oscillate even during cruising operation. Since the air-fuel mixture is also related to the throttle position, the exhaust sensor is affected by the change in throttle position such that it provides, during acceleration (or deceleration) an output which differs from those obtained during cruising or constantspeed operation. As a result, the integration prolongs to generate a correction signal of such an amplitude that it takes longer to return to the reference point when the engine enters the cruising state. This time lag during the transient period of engine operations will result in a large amplitude control swing above and below the reference point and could lead to a loss of control.

SUMMARY OF THE INVENTION

It is an object of the present invention to provide a control system to decrease the noxious components in the exhaust emission from internal combustion engines in which the correction signal is maintained at a constant value when the disturbance occurs to minimize the control oscillation.

Briefly, an engine condition sensor such as throttle position sensor is provided to detect disturbances to the engine such as acceleration or deceleration. The integral controller is arranged to interrupt its integration and provide a constant voltage corresponding to the reference point when the disturbance is detected. The time required for the correction signal to return to the reference point when the disturbance is removed therefore decreases.

BRIEF DESCRIPTION OF THE DRAWINGS

The invention will be described by way of example with reference to the accompanying drawings, in which.

DESCRIPTION OF THE PREFERRED EMBODIMENTS

Figure 1:
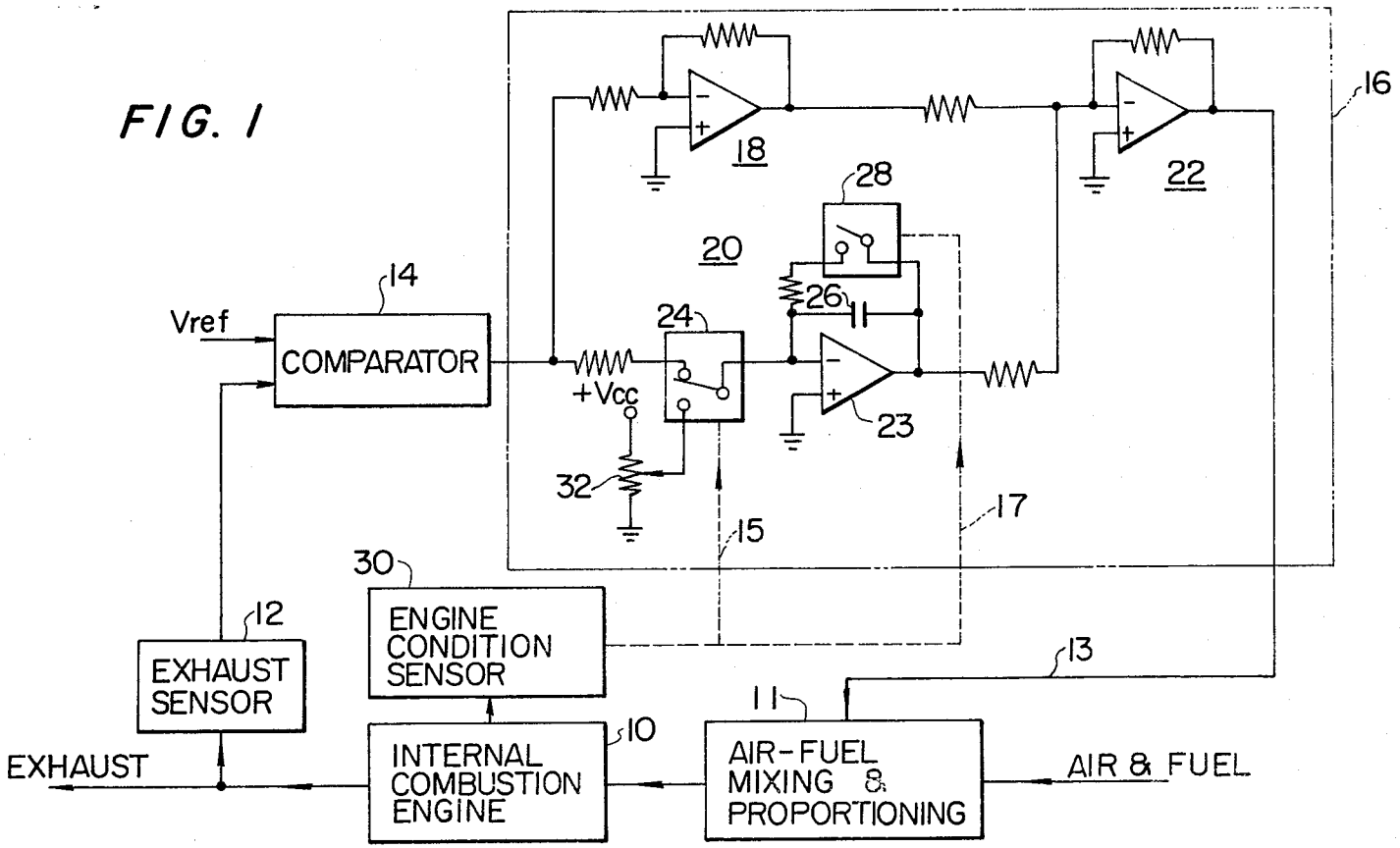
FIG. 1 is a circuit diagram, partly shown in blocks, of the embodiment of the invention.

Referring now to FIG. 1, an internal combustion engine schematically shown at 10 has its inlet side connected to an air-fuel mixing and proportioning device 11. The device 11 may, for example, be a carburetor, or a fuel injection system. The proportioning device 11 provides a predetermined quantity of air and fuel to the internal combustion engine 10. An exhaust sensor 12 extends into the exhaust passage to be exposed to the exhaust gases to provide an electrical output signal which depends on the composition of the gases in the exhaust from the internal combustion engine 10. The output signal from the sensor 12 is applied to one input of a comparator 14 for comparison with a reference voltage Vref to generate a signal representing the difference or deviation from the reference value. The difference signal from the comparator 14 is applied to a controller 16 which includes a proportional control operational amplifier 18 and an integral control operational amplifier 20, both operational amplifiers having their inputs connected to the output of comparator 14 and their outputs connected to a summation operational amplifier 22. The controller 16 provides an output signal to the air-fuel mixing and proportioning device 11 through line 13 to control the air-fuel ratio of the mixture so that the exhaust from the internal combustion engine will contain a minimum of noxious components. The integral controller 20 comprises an operational amplifier 23 with its inverting input terminal connected to the output of comparator 14 through the normally closed path of an electronic switch 24 and its non-inverting input connected to the ground potential. An integrating capacitor 26 is connected across the inverting input and output terminals of amplifier 23 to provide integration of the input signal. Across the capacitor 26 is connected a normally open electronic switch 28. An engine condition sensor such as throttle position sensor 30 is provided to detect transitional engine operating conditions under which the engine is operated with rich or lean mixture in response to the throttle operation. Such transitional conditions also include heavy load condition and start-up operation. The output from the sensor 30 is coupled over lines 15 and 17 to the electronic switches 24 and 28, respectively, to control their switching paths.

Figure 4A:
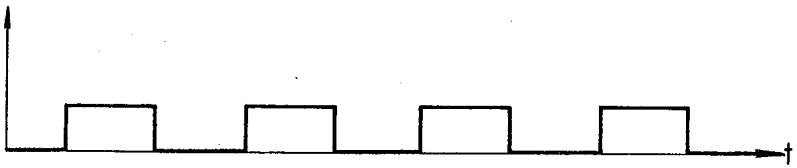
FIG. 4 is a waveform diagram useful for description of the invention.
Figure 4B:
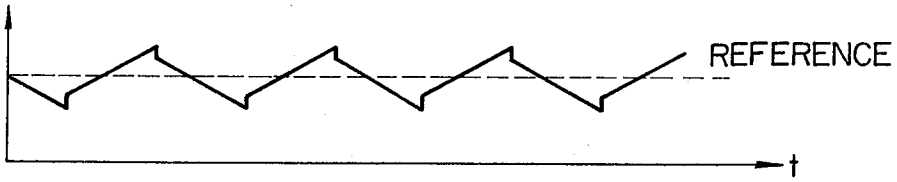

In operation, the exhaust composition representative signal from exhaust sensor 12 is compared with the stoichiometric air-fuel ratio represented by the reference voltage in comparator 14 to generate an output which indicates the deviation of the air-fuel ratio from the reference point. Due to the inherent delay time from the time of injection or supply of mixture to the engine to the time of a correction signal from controller 16, integral controller 20 keeps influencing the fuel quantity after the reference point has been passed as shown in FIG. **4*b* so that the signal from comparator 14** will appear as a train of pulses as shown in FIG. 4*b* even though the engine is driven at a constant speed. The output from comparator 14 is proportionally amplified by the operational amplifier 18 and at the same time applied to the integral controller 20.

Assume that vehicle is driven at a constant speed, electronic switches 24 and 28 remain inoperative so that the comparator output is integrated by integrator 20, the outputs from the proportional and integral amplifiers being additively applied to the summation amplifier 22 to provide a correction signal which charges linearly with time by integration and sharply at steps by proportional amplification, as illustrated in FIG. 4*b*. The air-fuel mixing and proportioning device 11 is controlled by the correction signal so that the air-fuel ratio of the mixture is controlled at the stoichiometric value.

Figure 4C:
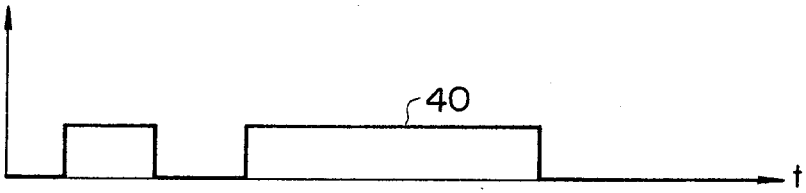

Under vehicle acceleration or deceleration conditions requiring rich or lean mixture respectively, comparator 12 generates an output signal 40 shown in FIG. 4*c* and throttle position sensor 30 detects such conditions and generates a control signal for electronic switches 24 and 28. Electronic switch 24 changes its conduction path to connect a DC voltage from a tap on resistor 32 to switch 28 which through its closed contacts connects the DC voltage to the summation input of amplifier 22. Therefore, the output of integral controller 23 suddenly changes to a constant value determined by adjustment of resistor 32. This constant value is preferably chosen at a voltage corresponding to the reference point so that when the engine condition returns to the constant speed drive with the switches 24 and 28 being returned to the normal positions, the correction signal starts to vary from the reference point. This confines the voltage swing, thus reducing the time required for the correction signal to return to the reference level.

Figure 2:
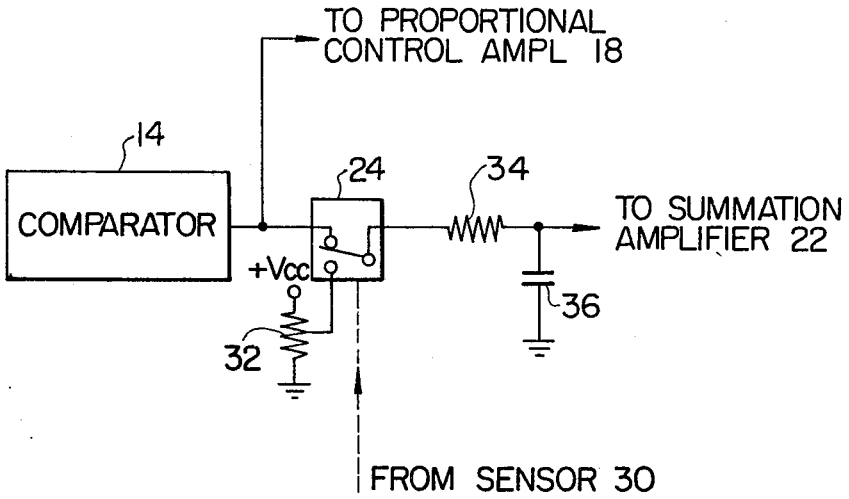
FIG. 2 is a modification of the integral controller of FIG. 1.

In the modification of the integral controller 20 as seen in FIG. 2, the operational amplifier 23 is replaced by a resistor 34 connected between the switch 24 and the input of summation amplifier 22 and a capacitor 36 connected between the junction between resistor 34 and summation amplifier 22 and ground. The capacitor 36 is charged up by the output signal from the comparator 14 during the constant speed drive to develop a voltage which increases or decreases in response to the voltage level of the comparator output. Under the transient conditions, the switch 24 is operated to connect the DC voltage from the tap on resistor 32 to the summation amplifier 22 while capacitor 36 is held at the DC voltage. In this modification, the integral control signal varies exponentially rather than linearly as in the previous example, while eliminating the electronic switch 28.

Figure 3:
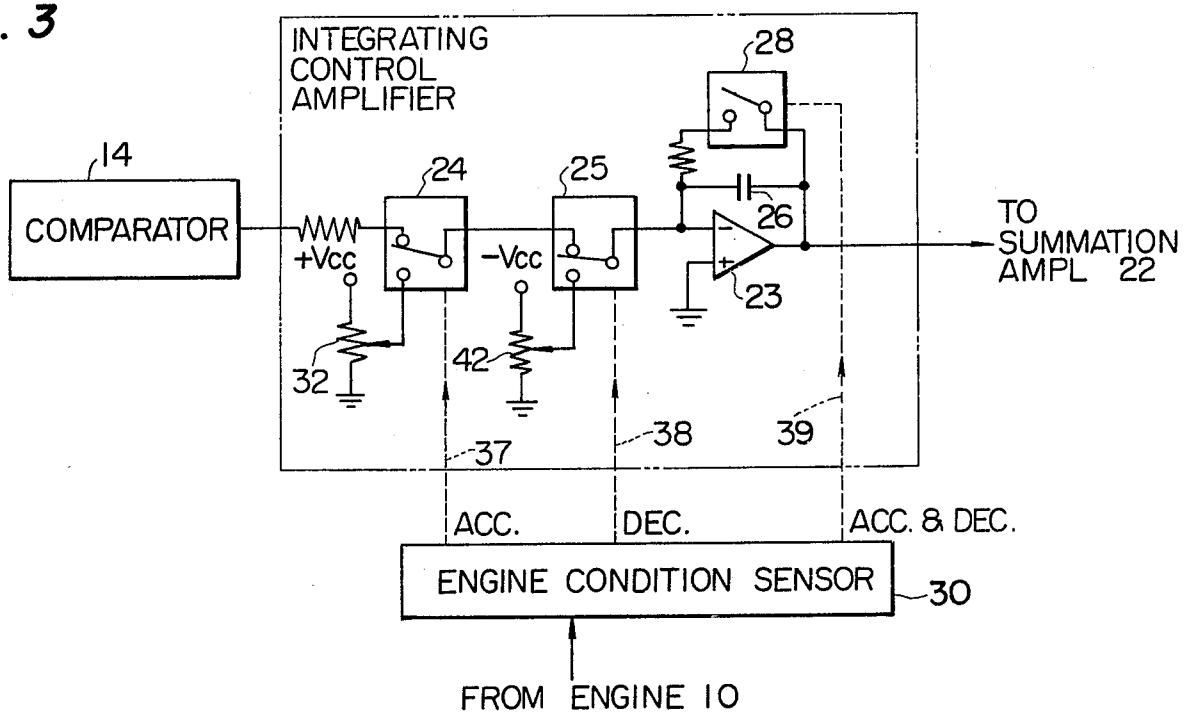
FIG. 3 is a further modification of the integral controller of FIG. 1.
Figure 4D:
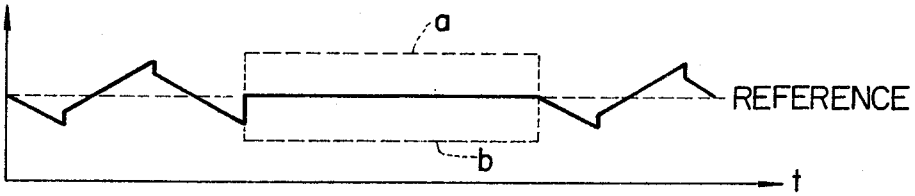

It is also possible to provide different correction signals during the transient periods depending on whether the engine is accelerated or decelerated. In FIG. 3, the engine condition sensor 30 generates a signal indicating acceleration or deceleration on leads 37 and 38, respectively, and a signal indicating either acceleration or deceleration on lead 39. An electronic switch 25 is additionally provided between the switch 24 and the inverting input of operational amplifier 23. With the engine operated at a constant speed, the comparator output is coupled through the normally closed contacts of switches 24 and 25 to the integral control amplifier 23 to permit it to integrate the signal applied thereto. Upon vehicle acceleration, sensor 30 provides signals over leads 37 and 39 to activate the switches 24 and 28 so that the DC voltage from resistor 32 is connected to the summation circuit 22 while discharging the energy stored in capacitor 26. The resistor 32 is adjusted to provide a voltage which is above the reference point as indicated by broken lines "*a*" in FIG. 4*d* so that the mixture becomes richer than stoichiometry. Upon vehicle deceleration, switches 25 and 28 are operated to connect a DC voltage from the tap on resistor 42 to the summation amplifier 22. The voltage from resistor 42 is adjusted at a value as indicated by broken lines "*b*" reference point so that the mixture becomes leaner than stoichiometry.

Figure 5:
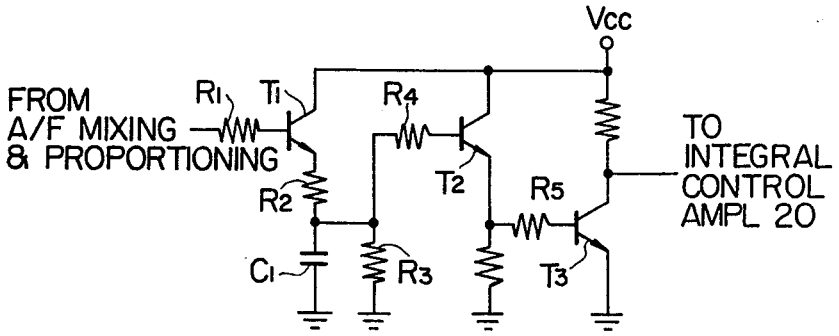
FIG. 5 is an example of the engine condition sensor of the apparatus.

FIG. 5 illustrates an example which is applicable to the detection of deceleration of an engine of electronic fuel injection type. Transistor T1 has its base connected to a source of control pulses that drive the fuel injector (not shown) to turn on and off in response to the applied input pulses. A capacitor C1 is coupled to the emitter of transistor T1 through resistor R2 to charge electrical energy in response to the turn-on of transistor T1. The voltage developed across capacitor C1 is coupled through resistors R3 and R4 to the base of a transistor T2 having its emitter connected to the base of a transistor T3 through resistor R5. When the voltage across C1 is above a predetermined level, transistors T2 and T3 are rendered conductive to provide a low output voltage from the collector of transistor T3. With vehicle deceleration, the pulse interval prolongs and as a result the voltage across C1 reduces to a level below the predetermined value so that transistors T2 and T3 become nonconductive to provide a high output signal. This signal serves as a control signal for the electronic switches of the integral controller 20.

The present invention has an additional advantage in that undesirable consequences such as large deviation of air-fuel ratio from the reference value resulting from malfunction of the exhaust sensor can be effectively avoided since the existence of such malfunction can also be recognized by the system as a disturbance to the system similar to vehicle acceleration or deceleration.

What is claimed is:

1. Fuel control apparatus for an internal combustion engine including sensing means for sensing the concentration of a component within a composition of exhaust gases from an internal combustion engine and providing an electrical signal representative of the sensed concentration; air-fuel supplying means for supplying air and fuel to the engine in a variable ratio; an integral controller connected to the exhaust composition sensing means to process the electrical signal and apply a feedback signal to the air-fuel supplying means to effect a minimum amount of noxious components in the exhaust gases from the engine;

means for sensing transient operating conditions of the engine; and switching means responsive to the sensed operating conditions of the engine for disconnecting passage of said electrical signal to the integral controller and connecting a predetermined DC voltage to said air-fuel supplying means.

2. Apparatus as claimed in claim 1, wherein said integral controller comprises a resistor and a capacitor connected is series to said switching means.

3. Apparatus as claimed in claim 1, wherein the integral controller includes an operational amplifier having an inverting input terminal connected to receive said electrical signal and a noninverting input terminal connected to a reference potential, an integrating capacitor connected between the inverting input terminal and the output terminal of the operational amplifier, and wherein the switching means includes first and second switch contact units responsive to the sensed engine operating conditions, means connecting the first switch contact unit between the exhaust composition sensing means and the operational amplifier to disconnect the passage of said electrical signal to the operational amplifier and connect said DC voltage to the air-fuel supplying means in response to said sensed engine operating conditions, and means connecting the second switch contact unit across said integrating capacitor to provide a short circuit thereacross in response to the sensed engine operating conditions.

4. Apparatus as claimed in claim 1, wherein the switching means includes first switch contact unit responsive to the sensed condition of the engine under acceleration, second switch contact unit responsive to the sensed condition of the engine under deceleration, means connecting the first and second switch contact units between the exhaust composition sensing means and the integral controller to disconnect the passage of the electrical signal to the integral controller and connect a first DC voltage to the air-fuel supplying means in response to the sensing of the engine's accelerating condition, and means connecting the second switch contact unit between the exhaust composition sensing means and the integral controller to disconnect the passage of the electrical signal to the integral controller and connect a second DC voltage to the air-fuel supplying means in response to the sensing of the engine's decelerating condition.

5. Apparatus as claimed in claim 4, wherein the integral controller includes an operational amplifier having an inverting input terminal connected to receive said electrical signal and a noninverting input terminal connected to a reference potential, an integrating capacitor connected between the inverting input terminal and the output terminal of the operational amplifier, and wherein the switching means further includes a third switch contact unit connected across said integrating capacitor to discharge electrical energy stored therein in response to the sensed engine operating conditions.

6. Apparatus as claimed in claim 1, further comprising a comparator for generating an output representative of the difference between the signal representative of the sensed concentration and a reference potential representing a desired air-fuel ratio and for applying said output to said integral controller.

7. Apparatus as claimed in claim 1, wherein the engine operating condition sensing means comprises a throttle position sensing means for sensing the positions of the throttle of said engine under acceleration or deceleration.

* * * * *